United States Patent [19]

Mombelli

[11] Patent Number: 4,519,640

[45] Date of Patent: May 28, 1985

[54] ELECTRONICALLY MOTORIZED LOCK WHOSE MOTOR SHAFT IS PARALLEL TO THE LONGITUDINAL AXIS OF THE BOLTS

[75] Inventor: Paup Mombelli, Nice, France

[73] Assignee: I.C.B. France Industrie et Componsants du Batiment Société Anonyme, Yzeure, France

[21] Appl. No.: 432,103

[22] Filed: Sep. 29, 1982

[30] Foreign Application Priority Data

Oct. 7, 1981 [FR] France ..... 81 19276

[51] Int. Cl.[3] ..... E05B 47/00; E05C 1/06

[52] U.S. Cl. ..... 292/33; 292/144; 70/417; 70/432; 70/280

[58] Field of Search ..... 292/33, 144, 201; 70/417, 432, 277, 279, 280, 281, 282

[56] References Cited

U.S. PATENT DOCUMENTS

| | | | |
|---|---|---|---|
| 3,427,835 | 2/1969 | Jeffee | 70/432 |
| 3,673,830 | 7/1972 | Billino | 70/417 |
| 4,135,377 | 1/1979 | Kleefeldt | 292/144 |
| 4,212,489 | 7/1980 | Snyder | 292/33 |
| 4,438,962 | 3/1984 | Soloviff | 292/144 |

FOREIGN PATENT DOCUMENTS 2280773 2/1976 France .

*Primary Examiner*—Robert L. Wolfe

*Attorney, Agent, or Firm*—Wenderoth, Lind & Ponack

[57] ABSTRACT

The lock comprises, integrated in the lock (V), mechanical safety means, an electric motor (2), a control module (1), one or more small switches (9) for communicating the position of the bolts (7), one or more detectors (10, 11) for detecting the open or closed state of the door, and the degree of impacts received by the door. The shaft of the motor (2) is parallel to the longitudinal axis of the bolts (7) and the bolts (7) are guided by apertures formed in branches of a U-shaped element (3) and are driven in translation by a driving member (6) but are free to rotate about their axes. The invention is applicable to electronic locks.

6 Claims, 2 Drawing Figures

ELECTRONICALLY MOTORIZED LOCK WHOSE MOTOR SHAFT IS PARALLEL TO THE LONGITUDINAL AXIS OF THE BOLTS

The invention relates to an electronically motorized lock controlled by a coded signal and having the shaft of the motor parallel to the longitudinal axis of the bolt or bolts.

Other electronically controlled locks exist. These electric locks or keepers operate not with integrated electric motors but by means of electromagnets. These locks cannot be considered as safety locks. Indeed, owing to the fact that the mechanism is based on electromagnets, these locks are easily forced and neutralized.

The invention tends to avoid these drawbacks. It provides an electronically motorized lock which is effectively a safety closure. Said lock is therefore only controlled by a coded signal.

Of course, the same door or different doors may be actuated simultaneously without any mechanical connection therebetween. For this purpose, the shaft of the motor is parallel to the longitudinal axis of the bolt or bolts, the latter are cylindrical and freely mounted so as to be capable of rotating and thus allow no bite of the teeth of a saw for example. One or more means permanently indicate the position of the bolt or bolts, one or more means indicate if the door is open or closed, one or more detecting means provide information concerning the degree of the impact or impacts on the lock or in the region of the door, and electronic means permit opening orders to be given by coded electronic signals.

The accompanying Figures, given merely by way of example to which the scope of the invention is not intended to be limited, will permit the invention to be easily understood. They show a preferred embodiment of the invention:

Figure 1:
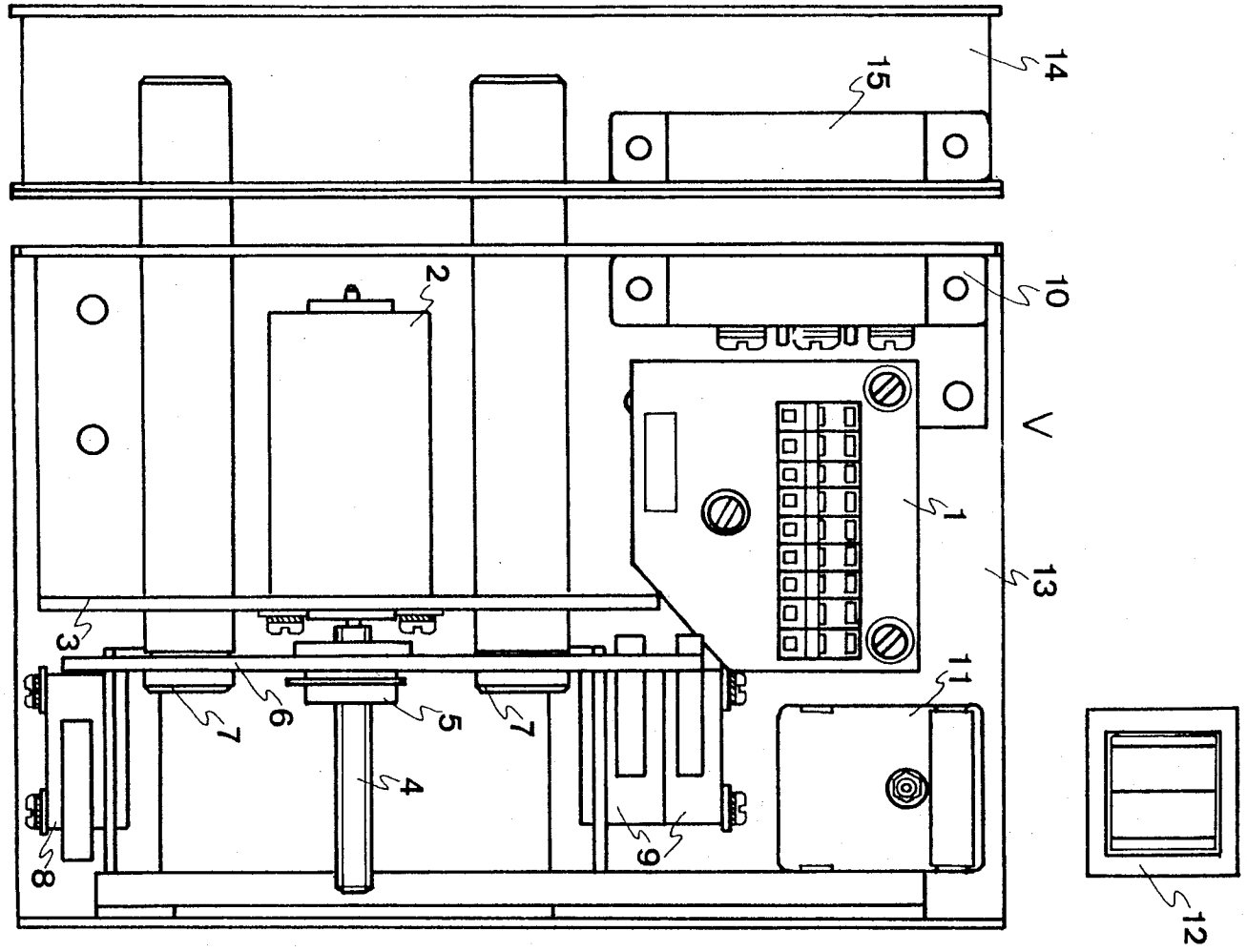
FIG. 1 is a diagrammatic plan view of the motorized lock.

A control module 1 is constituted by a printed circuit carrying electronic components and terminal means for connecting the wires connecting the lock V to the electronic centre or unit.

An opening and closing order coming from the electronic unit arrives at the module in the form of an electric signal. If the characteristics of the signal are in conformity to those required by the procedure previously defined for the lock V, the control module will initiate the carrying out of the order. The lock can only be controlled by a signal.

The required signal may be a simple DC voltage of a well-defined level and direction or a complex coded information requiring an electronic decoding in order to be recognized.

A low tension DC motor 2 is secured to the inner wall of a U-shaped element 3 rigid with the plate 13 carrying all of the components of the lock.

Adhered to the shaft of this motor is a lead-screw 4 on which a nut 5 is shifted, this nut being prevented from rotating by a driving member 6. The latter comprises two semi-circular forks at its ends which maintain the two cylindrical bolts 7 in position by grooves.

The bolts 7 are guided by apertures provided in the branches of the U-shaped element 3 and driven in translation by the member 6, but are free to rotate about their axes. Consequently, they permit no bite of the teeth of a saw for example.

When the lead-screw 4 under the action of the motor 2 rotates in the screwing direction, the nut 5 is moved from the rear toward the front of the lock. The bolts 7 driven by the member 6 move outwardly of the lock and enter the keeper 14. When the lead-screw 4 rotates in the unscrewing direction, the nut 5 is shifted from the front toward the rear and the bolts 7 move inwardly of the lock and release the keeper 14.

The movement is limited in the rearward direction by the action of a finger portion of the member 6 on a small switch 8 which acts on the control module 1. The movement is limited in the forward direction by the action of a second finger portion of the member 6 on two coupled small switches 9 which also act on the control module. These switches 8, 9 may be replaced by detectors.

The lock V contains, in addition to the described elements which enable it to operate, two detectors 10 and 11 employed for auxiliary functions for the purpose of simplifying the equipment of the door.

A magnetic reversing switch 10 enables the lock to be automatically closed when it is in concordance with with the magnet 15 contained by the keeper 14 and also serves to set off an alarm when the door is forced open without actuation of the lock by means of the control module.

An inertia detector 11 generates an electric signal when the plate 13 of the lock V on which it is mounted and which is rigid with the door or the door frame, receives vibrations coming from impacts to which the door opening is subjected. This electric signal transmited to the electronic centre or unit will set off a dissuasive alarm after analysis.

A reversing switch 12 may be placed on the case (not shown) of the lock V. This reversing switch 12 is directly connected to the control module and it enables the lock V to be opened or closed from inside the room without need to send the coded signal required for operating the module 1.

For the use of the lock on door openings of public premises subjected to "anti-panic" safety regulations, a lock W is provided which is a modification of the invention.

The operation and the main technical characteristics are similar, but springs 16 are added to the bolts 10 for exerting a force which tends to urge the latter rearwardly. The nut 5 is fixed to move in translation with the member 6 by a pin 17 which is connected by a chain 8 to a ring 19 which is accessible from outside the lock W. This pin 17 may be replaced by a circlip.

When a pull is exerted on the ring, the pin 17 is pulled away and the bolts 7, biased rearwardly by the springs, drive the member 6, which is no longer connected to the nut 5, and the assembly will position itself at the rear of the lock which will remain in the open position, even if a reverse order is set to the control module 1.

Figure 2:
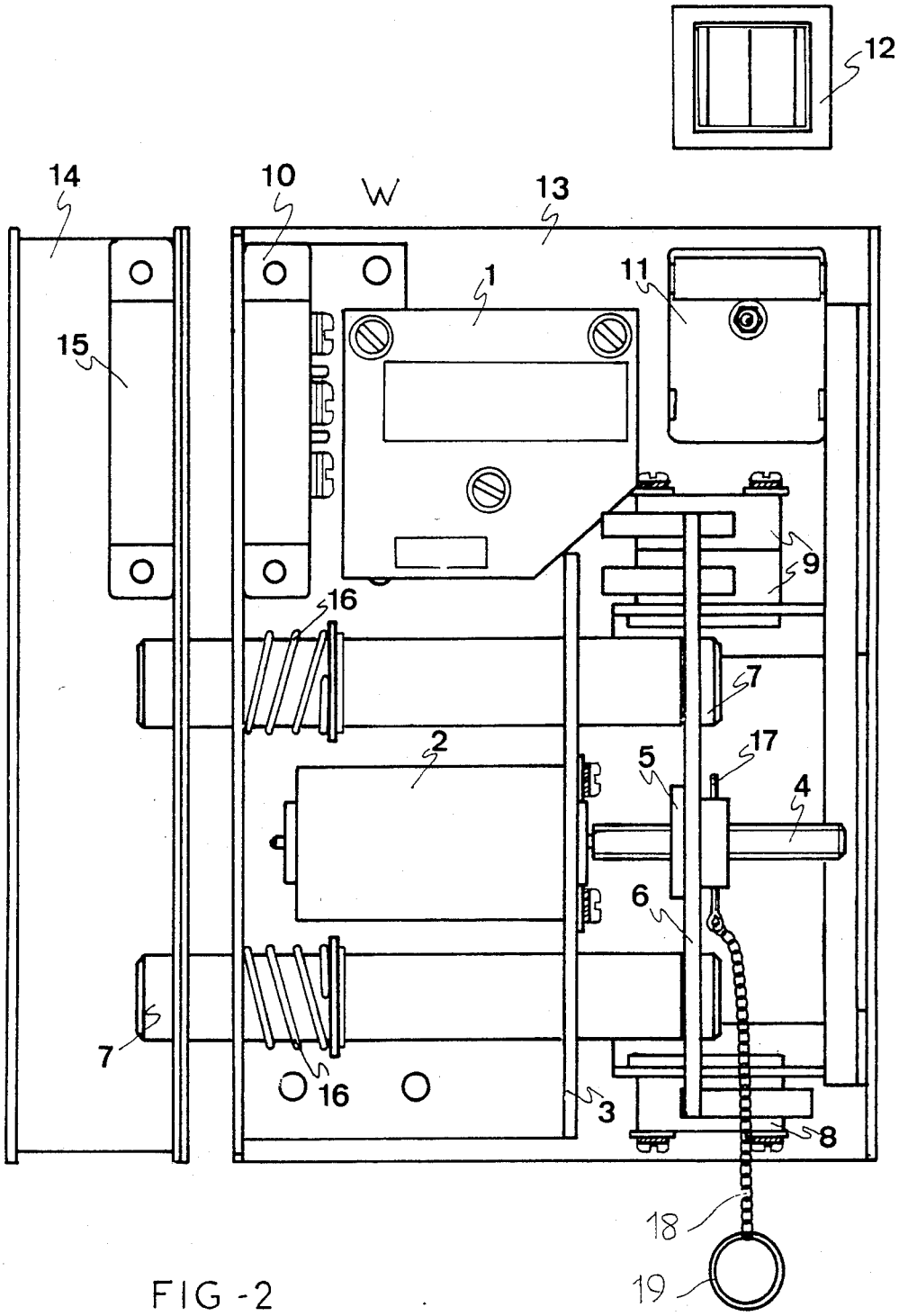
FIG. 2 is a diagrammatic plan view of the motorized lock in a modification in which anti-panic means are combined with the lock assembly.

The unlocking ring 19 may be connected to the anti-panic bar (not shown in FIG. 2) with which the door opening is provided.

Having now described my invention what I claim as new and desire to secure by Letters Patent is:

1. An electronically motorized lock to be mounted on a door, said lock comprising, integrated in the lock, mechanical safety means, an electric motor, a control module, bolt means movable between a locking position and an unlocking position the mechanical safety means comprising an arrangement wherein the motor has an output shaft which is parallel to a longitudinal axis of the bolt means, along which axis the bolt means are movable, means for connecting the motor to the bolt means for shifting the bolt means between the unlocking position and the locking position, the bolt means comprising a plurality of bolts and the mechanical safety means comprising a U-shaped element defining apertures in branches of the U-shaped element, the bolts being guided in said apertures and a driving member which is part of said connecting means being drivingly engaged with the bolts, switch means for communicating the position of the bolt means, and detecting means for detecting an open or closed state of the door and for detecting impacts received by the door, and wherein the motor is a low-tension DC motor having an output shaft and is fixed to an inner wall of a U-shaped element which is rigid with a plate carrying all of the components of the lock, a lead-screw being secured to said output shaft, and a nut being screwthreadedly engaged with the lead-screw and being prevented from rotating by a driving member which drivingly engages the bolt means.

2. A lock according to claim 1, wherein the driving member comprises two sem-circular forks at opposite ends thereof which forks engage grooves in the cylindrical bolts for maintaining the bolts axially in position.

3. A lock according to any one of the claims 1 or 2, comprising, for limiting the movement of the bolt means, a finger member included in said connecting means, a first switch means connected to act on the control module, the finger member being adapted to open the first switch means at a rearward end of said movement, a second finger member included in said connecting means and second switch means connected to act on the control module, the second finger member being adapted to open the second switch means at a forward end of said movement.

4. A lock according to any one of the claims 1 or 2, comprising a magnetic reversing switch for closing the lock automatically when it is in concordance with a magnet contained in a keeper for the lock and associated with an alarm for setting off the alarm when the door is forced open without actuation of the lock by means of the control module.

5. A lock according to any one of the claims 1 or 2, comprising an inertia detector which is associated with means for generating an electric signal when a plate of the lock on which plate it is fixed and which plate is also rigid with the door or the door frame, receives vibrations coming from impacts on the door opening.

6. A lock according to claim 1, further comprising spring means combined with the bolt means for biasing the bolt means rearwardly, the connecting means comprising a lead-screw drivenly connected to the motor, a nut screwthreadedly mounted on the lead-screw, a driving member drivingly connected to the bolt means and means releasably connecting the nut to the driving member so that it moves in translation with the driving member, a ring accessible from outside the lock and a chain connecting the ring to the releasable connecting means so that a pull exerted on the ring releases the driving member from the nut and the bolt means, which are biased rearwardly by the srings, drive the driving member which is no longer connected to the nut and the bolt means are positioned in an unlocking position and the lock will remain in an open position even if a reverse order is sent to the control module.

* * * * *